US007997880B2

(12) United States Patent
Lim et al.

(10) Patent No.: US 7,997,880 B2
(45) Date of Patent: Aug. 16, 2011

(54) COMPRESSOR

(75) Inventors: Kweonsoo Lim, Daejeon-si (KR); Mingyu Kim, Daejeon-si (KR); Jeongjae Lee, Daejeon-si (KR); Duckbin Yoon, Daejeon-si (KR)

(73) Assignee: Halla Climate Control Corporation, Daejeon-Si (KR)

( * ) Notice: Subject to any disclaimer, the term of this patent is extended or adjusted under 35 U.S.C. 154(b) by 874 days.

(21) Appl. No.: 11/989,461

(22) PCT Filed: Aug. 11, 2006

(86) PCT No.: PCT/KR2006/003141
§ 371 (c)(1),
(2), (4) Date: Jan. 25, 2008

(87) PCT Pub. No.: WO2007/021095
PCT Pub. Date: Feb. 22, 2007

(65) Prior Publication Data

US 2009/0116974 A1 May 7, 2009

(30) Foreign Application Priority Data

Aug. 12, 2005 (KR) ..... 10-2005-0074185
Aug. 7, 2006 (KR) ..... 10-2006-0074133

(51) Int. Cl.
*F04B 1/12* (2006.01)
*F01B 3/00* (2006.01)

(52) U.S. Cl. ..... 417/269; 92/71

(58) Field of Classification Search ..... 417/269; 92/71
See application file for complete search history.

(56) References Cited

U.S. PATENT DOCUMENTS

| | | | | |
|---|---|---|---|---|
| 5,362,208 | A * | 11/1994 | Inagaki et al. | 417/269 |
| 5,478,212 | A * | 12/1995 | Sakai et al. | 417/269 |
| 5,921,756 | A * | 7/1999 | Matsuda et al. | 417/269 |
| 6,280,153 | B1 * | 8/2001 | Iversen et al. | 417/312 |
| 6,988,875 | B2 * | 1/2006 | Shintoku et al. | 417/269 |
| 2003/0146053 | A1 | 8/2003 | Shintoku et al. | |
| 2004/0197202 | A1 * | 10/2004 | Saiki et al. | 417/269 |

FOREIGN PATENT DOCUMENTS

| | | | |
|---|---|---|---|
| JP | 05-312145 | A | 11/1993 |
| JP | 5312145 | A | 11/1993 |
| JP | 07-119631 | A | 5/1995 |
| JP | 2003-247486 | | 9/2003 |
| KR | 1020030047729 | A | 6/2003 |

* cited by examiner

*Primary Examiner* — Charles Freay
(74) *Attorney, Agent, or Firm* — Fulbright & Jaworski L.L.P.

(57) ABSTRACT

The present invention relates to a compressor, which can inhale refrigerant supplied to a swash plate chamber to cylinder bores through the inside of a driving shaft so that a flow channel structure is simplified, thereby enhancing a suction volumetric efficiency by reducing a loss due to flow channel resistance and elastic resistance, and enhancing a compression efficiency by uniformly distributing refrigerant to the cylinder bores located at both sides of the swash plate chamber.

6 Claims, 6 Drawing Sheets

[Fig. 1]
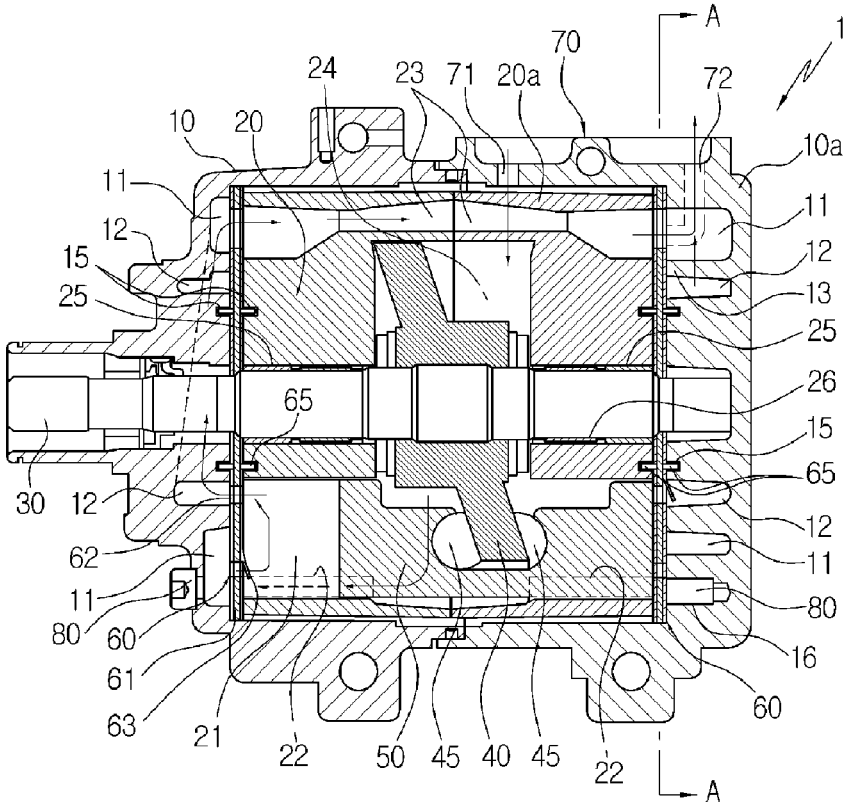
[Fig. 2]
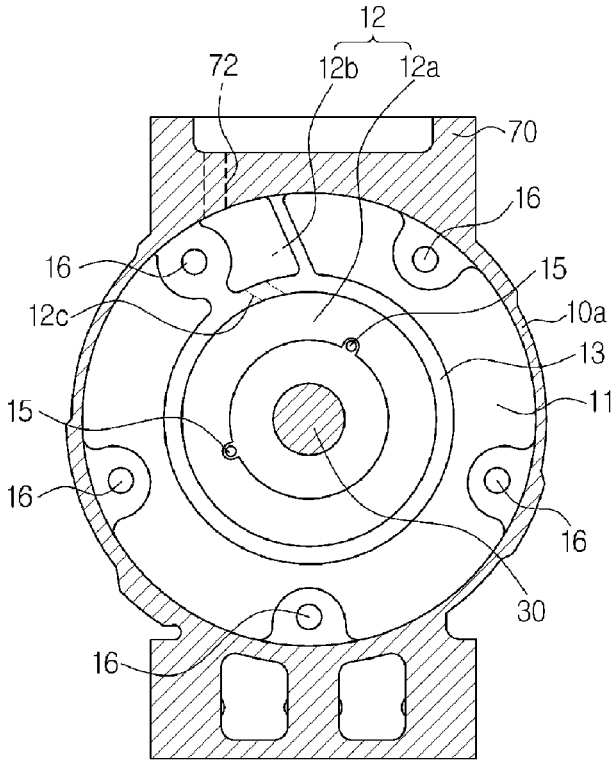

[Fig. 3]
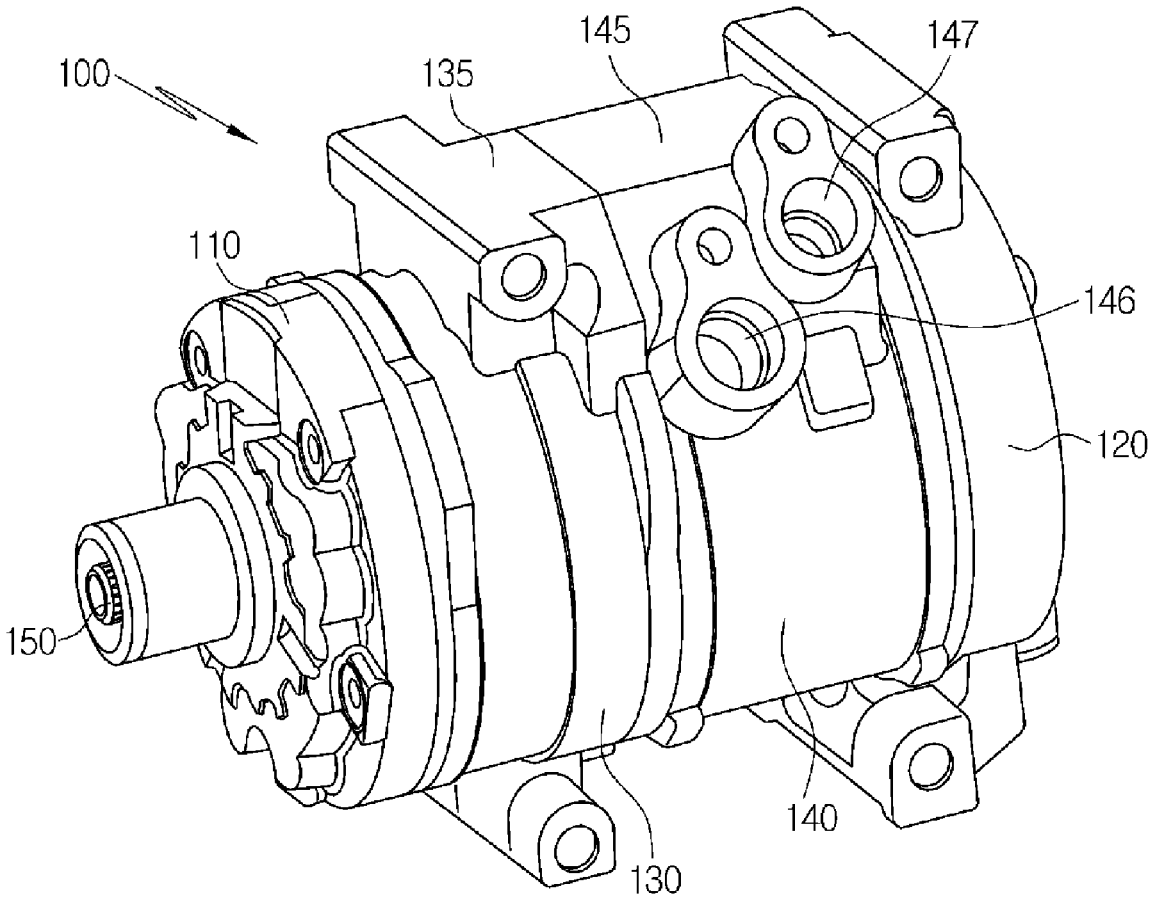

[Fig. 4]
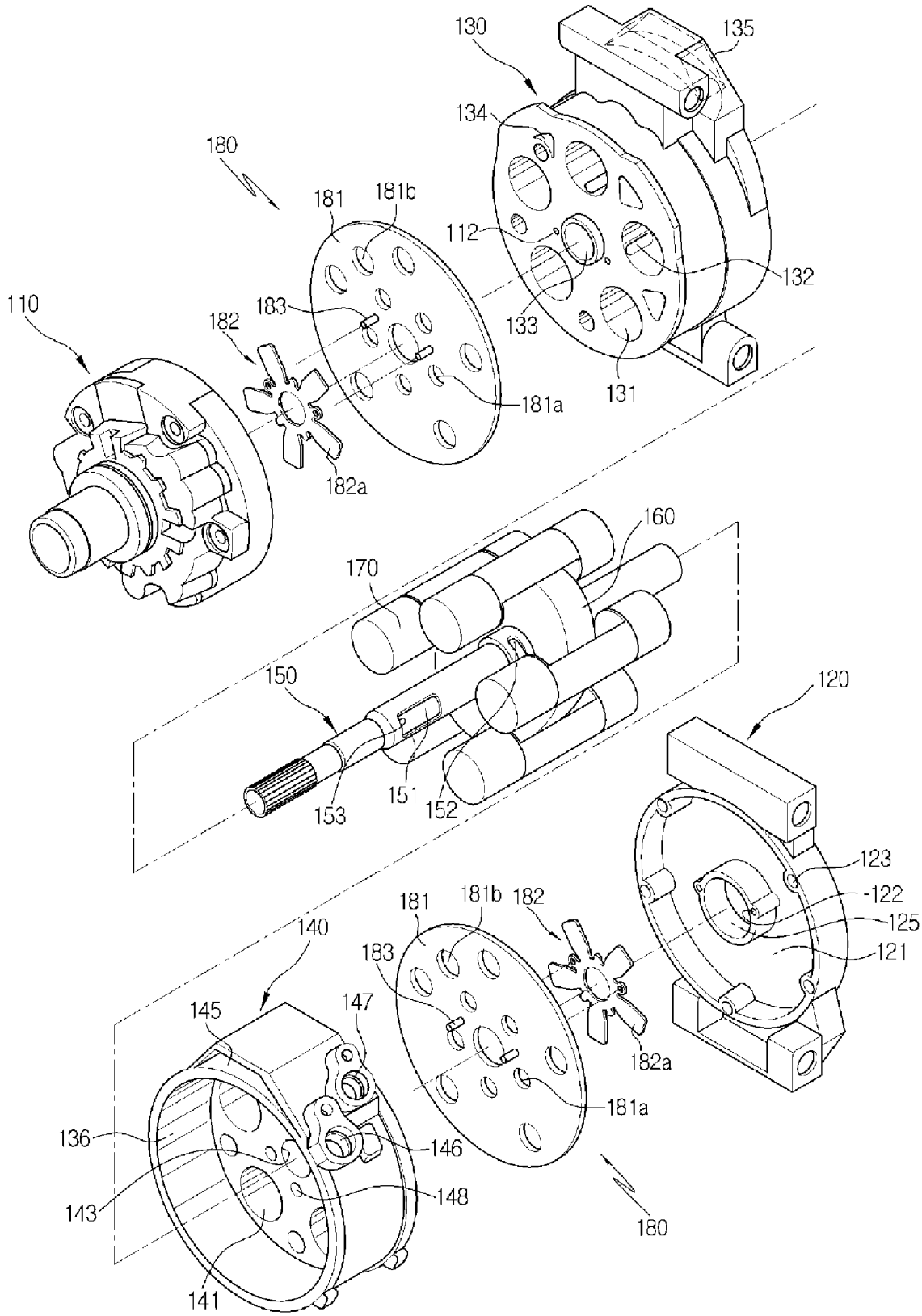

[Fig. 5]
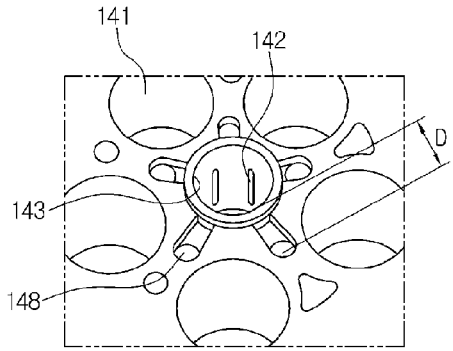
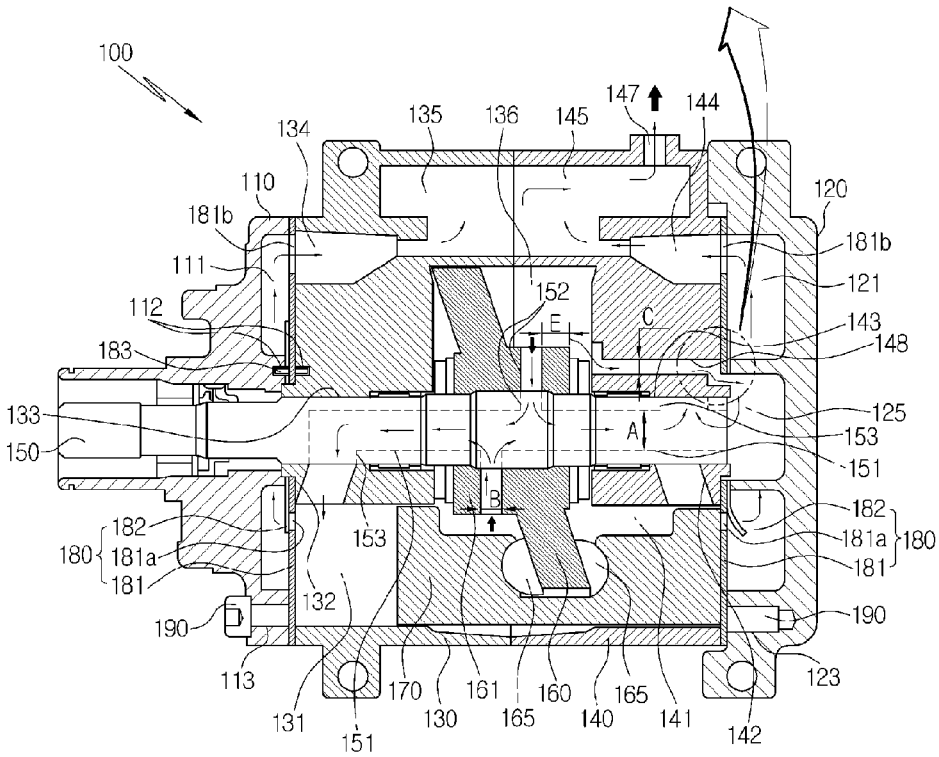
[Fig. 6]
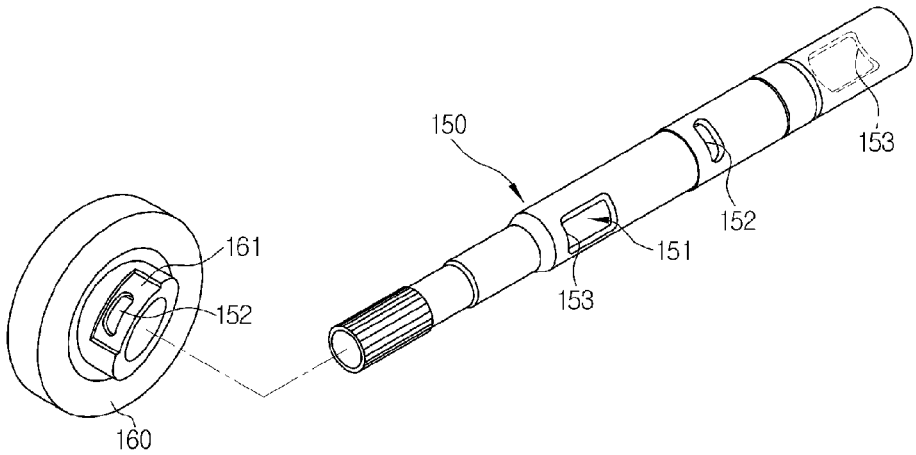

[Fig. 7]
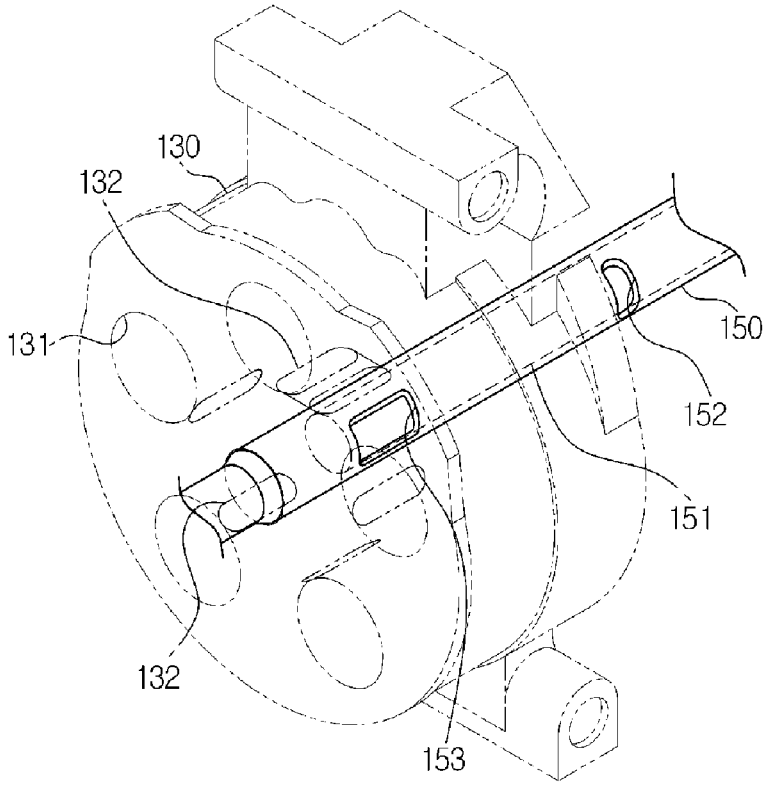
[Fig. 8]
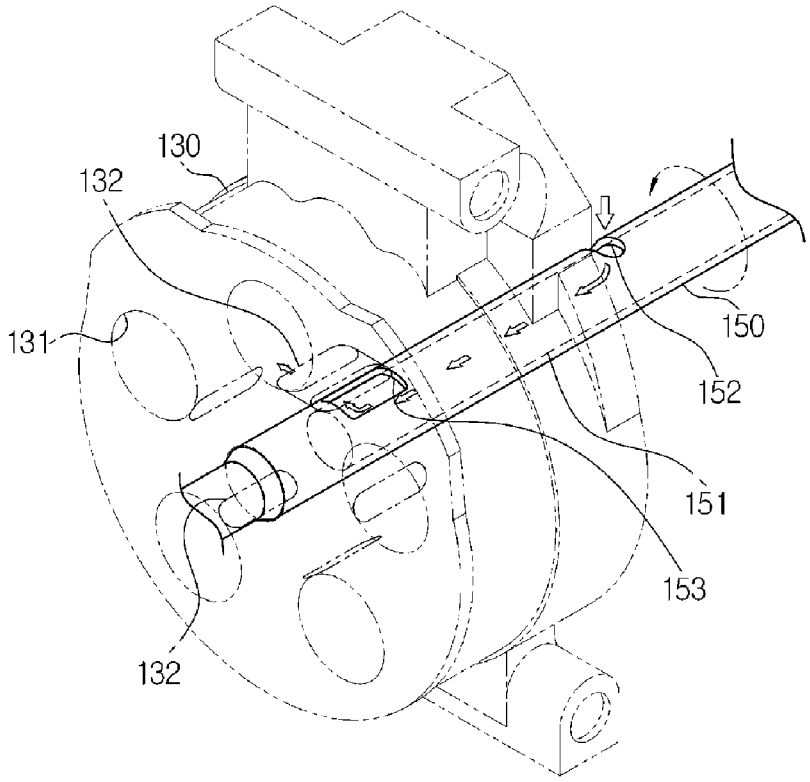

[Fig. 9]
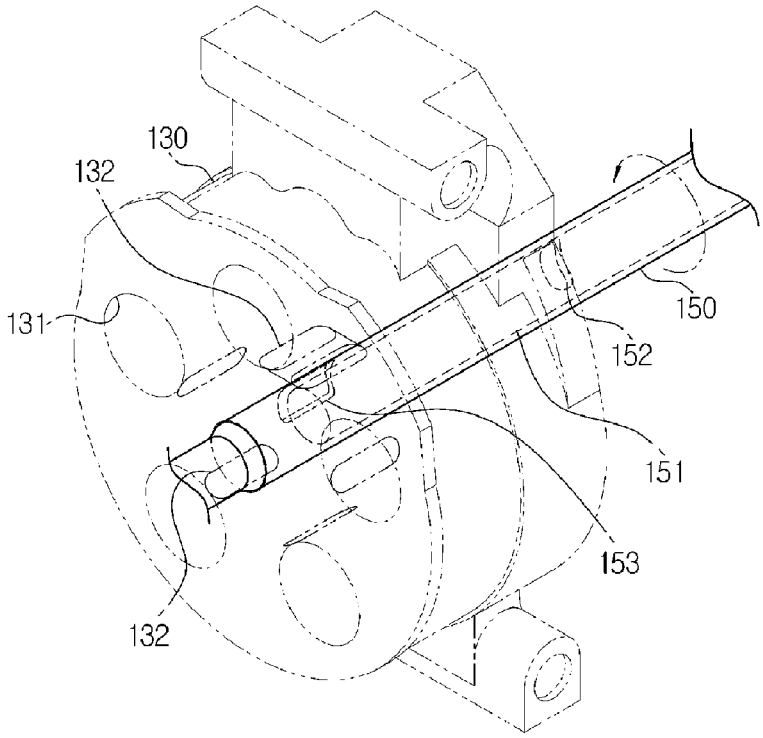
[Fig. 10]
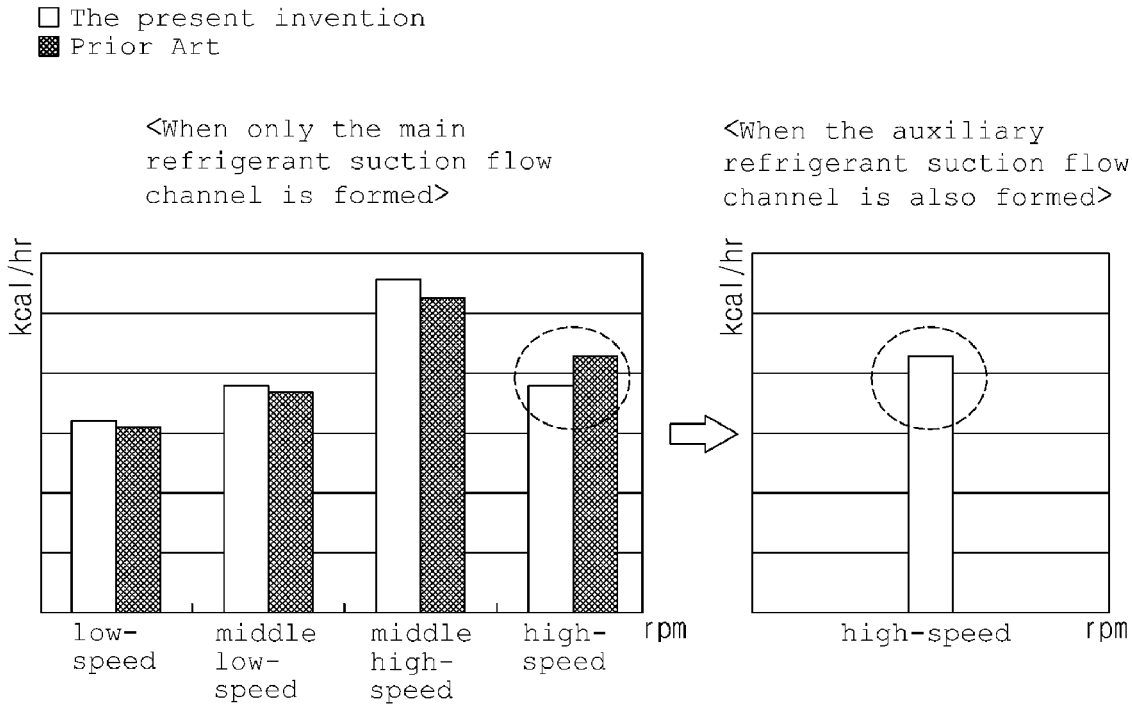

COMPRESSOR

This application is a §371 of PCT/KR2006/003141 filed Aug. 11, 2006, which claims priority from Korean Patent Application No: 10-2005-0074185 filed Aug. 12, 2005 and Korean Patent Application No: 10-2006-0074133 filed Aug. 7, 2006.

TECHNICAL FIELD

The present invention relates to a compressor, and more particularly, to a compressor, which can inhale refrigerant supplied to a swash plate chamber to cylinder bores through the inside of a driving shaft so that a flow channel structure is simplified, thereby enhancing a suction volumetric efficiency by reducing a loss due to flow channel resistance and elastic resistance, and enhancing a compression efficiency by uniformly distributing refrigerant to the cylinder bores located at both sides of the swash plate chamber.

BACKGROUND ART

In general, a compressor for an automobile inhales refrigerant discharged after the refrigerant evaporated in an evaporator, converts it into liquescent refrigerant gas of high-temperature and high-pressure, and then, discharges it to a condenser.

There are compressors of various kinds, for example, a swash plate type compressor that pistons perform a reciprocating motion by rotation of an inclined swash plate, a scroll type compressor performing compression by rotation of two scrolls, a vane rotary type compressor performing compression by a rotary vane, and so on.

Out of the above compressors, the reciprocating type compressor compressing refrigerant according to the reciprocating motion of the piston is classified into the swash plate type, a crank type, and a wobble plate type, and the swash plate type compressor is also classified into a fixed capacity type and a variable capacity type according to a use purpose.

FIGS. 1 and 2 are views showing a prior art fixed capacity swash plate type compressor. Referring to the drawings, the fixed capacity swash plate type compressor will be described in brief as follows.

As shown in the drawings, the swash plate type compressor 1 includes a front housing 10 having a front cylinder block 20 therein, and a rear housing 10*a* coupled with the front housing 10 and having a rear cylinder block 20*a* therein.

Each of the front and rear housings 10 and 10*a* has a discharge chamber 12 and a suction chamber 11 formed inside and outside a partition 13 in correspondence with a refrigerant discharge hole and a refrigerant suction hole of a valve plate 61, which will be described later.

Here, the discharge chamber 12 includes: a first discharge chamber 12*a* formed inside the partition 13; and a second discharge chamber 12*b* formed outside the partition 13, divided from the suction chamber 11, and fluidically communicated with the first discharge chamber 12*a* through a discharge hole 12*c*.

That is, refrigerant of the first discharge chamber 12*a* is contracted when it passes through the discharge hole 12*c* of a small diameter but expanded when it flows to the second discharge chamber 12*b*. In this instance, pulsating pressure drops to reduce vibration and noise during the contraction and expansion of the refrigerant.

Meanwhile, a plurality of bolt coupling holes 16 are formed on the suction chamber 11 in a circumferential direction. The front and rear housings 10 and 10*a* are coupled and fixed with each other through the bolt coupling holes 16 via bolts 80 in a state where a plurality of components are assembled inside the front and rear housings 10 and 10*a*.

After that, the front and rear cylinder blocks 20 and 20*a* respectively have a plurality of cylinder bores 21 therein, and pistons 50 are combined to the corresponding cylinder bores 21 of the front and rear cylinder blocks 20 and 20*a* in such a way that the pistons 50 perform a straight reciprocating motion. In this instance, the pistons 50 are connected to a driving shaft 30 by interposing a shoe 45 on the outer periphery of a swash plate 40 inclinedly mounted to the driving shaft 30.

So, the pistons 50 reciprocate inside the cylinder bores 21 of the front and rear cylinder blocks 20 and 20*a* while cooperating with the swash plate 40 rotating with the driving shaft 30.

Moreover, valve units 60 are respectively mounted between the front and rear housings 10 and 10*a* and the front and rear cylinder blocks 20 and 20*a*.

Here, the valve unit 60 includes a valve plate 61 having a refrigerant suction hole and a refrigerant discharge hole, and a suction reed valve 63 and a discharge reed valve 63, which are mounted on both sides of the valve plate 61.

The valve units 60 are respectively assembled between the front and rear housings 10 and 10*a* and the front and rear cylinder blocks 20 and 20*a*, and in this instance, the position of the valve unit 60 is fixed while fixing pins 65 formed at both sides of the valve plate 61 are inserted into fixing holes 15 formed on the surfaces of the front housing 10 and the front cylinder block 20 and on the surfaces of the rear housing 10*a* and the rear cylinder block 20*a*.

Meanwhile, the front and rear cylinder blocks 20 and 20*a* have a plurality of suction passageways 22 therein, so that the refrigerant supplied to a swash plate chamber 24 disposed between the front and rear cylinder blocks 20 and 20*a* is flown to each suction chamber 11, and second discharge chambers 12*b* of the front and rear housings 10 and 10*a* are fluidically communicated with each other by connection passageways 23 formed through the front and rear cylinder blocks 20 and 20*a*.

Therefore, suction and compression of the refrigerant can be performed simultaneously inside the bores 21 of the front and rear cylinder blocks 20 and 20*a* according to the reciprocating motion of the pistons 50.

Each of the front and rear cylinder blocks 20 and 20*a* has a shaft support hole 25 formed at the center thereof to support the diving shaft 30, and a needle roller bearing 26 interposed inside the shaft support hole 25 to rotatably support the driving shaft 30.

Meanwhile, The rear housing 10*a* includes a muffler 70 formed on the upper portion of the outer periphery thereof to supply the refrigerant transmitted from an evaporator to the inside of the compressor 1 during a suction stroke of the piston 50, and to discharge the refrigerant compressed in the compressor 1 toward a condenser during a compression stroke of the piston 50.

Hereinafter, a refrigerant circulating process of the compressor 1 having the above structure will be described.

The refrigerant supplied from the evaporator is supplied to the swash plate chamber 24 between the front and rear cylinder blocks 20 and 20*a* through a refrigerant suction hole 71 after the refrigerant is inhaled to a suction part of the muffler 70, and then, flown to the suction chambers 11 of the front and rear housings 10 and 10*a* along the suction passageways 22 formed in the front and rear cylinder blocks 20 and 20*a*.

After that, the suction reed valve 63 is opened during the suction stroke of the piston 50, and in this instance, the refrigerant contained inside the suction chamber 11 is inhaled into the cylinder bore 21 through the refrigerant suction hole of the valve plate.

After that, the refrigerant of the cylinder bore 21 is compressed during the compression stroke of the piston 50, and in this instance, the discharge reed valve 62 is opened, and the refrigerant is flown to the front discharge chambers 12*a* of the front and rear housings 10 and 10*a* through the refrigerant discharge hole of the valve plate.

Continuously, the refrigerant flown to the first discharge chambers 12*a* is discharged to a discharge pair of the muffler 70 through a refrigerant discharge hole 72 of the muffler 70 after passing the second discharge chambers 12*b*, and then, flows to the condenser.

Meanwhile, the refrigerant compressed in the cylinder bore 21 of the front cylinder block 20 is discharged to the first discharge chamber 12*a* of the front housing 10, flows to the second discharge chamber 12*b* of the rear housing 10*a* along the connection passageways 23 formed in the front and rear cylinder blocks 20 and 20*a* after flowing to the second discharge chamber 12*b* of the front cylinder block 20, and then, discharged to the discharge part of the muffler 70 through the refrigerant discharge hole 72 together with refrigerant of the second discharge chamber 12*b* of the rear housing 10*a*.

However, the prior art compressor 1 has a disadvantage in that suction volumetric efficiency of refrigerant is decreased due to a loss caused by suction resistance generated by complicated refrigerant flow channels and a loss caused by elastic resistance of the suction reed valve 63 generated during opening and closing of the valve unit 60.

Meanwhile, Korean Patent Laid-open publication No. 2003-47729 discloses a lubricating structure in a fixed capacity piston type compressor, which is a technology to reduce a loss caused by elastic resistance of the suction reed valve 63. That is, the above technology adopts a suction rotary valve integrated with a driving shaft without the suction reed valve, so that refrigerant directly flows from the rear portion of the driving shaft into a cylinder bore through the driving shaft to reduce the loss caused by suction resistance.

However, the prior art has a disadvantage in that the compressor cannot show the optimal compression performance, since refrigerant is inhaled from the rear portion of the driving shaft, and so, a great deal of refrigerant flows into the rear cylinder bore and refrigerant of a small quantity flows into the front cylinder bore.

In addition, the prior art has another disadvantage in that there is a restriction in design, for example, a refrigerant suction part must be formed on the rear portion of the driving shaft.

DISCLOSURE OF INVENTION

Technical Problem

Accordingly, it is an object of the present invention to provide a compressor, which can inhale refrigerant supplied to a swash plate chamber to cylinder bores through the inside of a driving shaft so that a flow channel structure is simplified, thereby enhancing a suction volumetric efficiency by reducing a loss due to flow channel resistance and elastic resistance, and enhancing a compression efficiency by uniformly distributing refrigerant to the cylinder bores located at both sides of the swash plate chamber.

Technical Solution

To achieve the above objects, the present invention provides a compressor, which includes: a driving shaft to which a swash plate rotating in a swash plate chamber inside the compressor is inclinedly combined, the driving shaft having a main refrigerant suction flow channel formed therein so that refrigerant inhaled into the swash plate chamber passes through the swash plate and moves toward cylinder bores; front and rear cylinder blocks respectively having shaft support holes to which the driving shaft is rotatably mounted, a plurality of the cylinder bores formed at both sides of the swash plate chamber, and suction passageways for fluidically communicating the shaft support holes and the cylinder bores with each other so that the refrigerant inhaled into the main refrigerant suction flow channel of the driving shaft is inhaled into the cylinder bores in order during rotation of the driving shaft; a plurality of pistons mounted on the outer periphery of the swash plate in such a manner as to interpose a shoe between the piston and the swash plate, for performing a reciprocating motion inside the cylinder bores while cooperating with the rotation of the swash plate; front and rear housings coupled with both sides of the front and rear cylinder blocks and respectively having discharge chambers formed therein; and valve units interposed between the front and rear cylinder blocks and the front and rear housing, wherein when the diameter of the main refrigerant suction flow channel is A and the hydraulic diameter of an inlet of the main refrigerant suction flow channel is B, suction resistivity (R) of the inlet of the main refrigerant suction flow channel is defined as the following formula $$\frac{B}{A}$$

and satisfies the following formula, $0.5 \leqq R \leqq 1.3$.

BRIEF DESCRIPTION OF THE DRAWINGS

FIG. 1 is a sectional view of a prior art compressor.

FIG. 2 is a sectional view taken along the line of A-A of FIG. 1.

FIG. 3 is a perspective view of a compressor according to the present invention.

FIG. 4 is an exploded perspective view of the compressor according to the present invention.

FIG. 5 is a sectional view and a partially enlarged perspective view of the compressor according to the present invention.

FIG. 6 is a perspective view showing a state where a driving shaft and a swash plate are disassembled from the compressor according to the present invention.

FIGS. 7 to 9 are brief perspective views showing a process that refrigerant of a swash plate chamber is inhaled to a cylinder bore through a main refrigerant suction flow channel according to rotation of the driving shaft.

FIG. 10 is a graph for comparing performance of the compressor according to the present invention with performance of the prior art compressor.

MODE FOR THE INVENTION

Reference will now be made in detail to the preferred embodiments of the present invention, examples of which are illustrated in the accompanying drawings.

In the present invention, description of the same parts and actions as the prior arts will be omitted.

FIG. 3 is a perspective view of a compressor according to the present invention, FIG. 4 is an exploded perspective view of the compressor according to the present invention, FIG. 5 is a sectional view and a partially enlarged perspective view of the compressor according to the present invention, FIG. 6 is a perspective view showing a state where a driving shaft and a swash plate are disassembled from the compressor according to the present invention, FIGS. 7 to 9 are brief perspective views showing a process that refrigerant of a swash plate chamber is inhaled to a cylinder bore through a main refrigerant suction flow channel according to rotation of the driving shaft, and FIG. 10 is a graph for comparing performance of the compressor according to the present invention with performance of the prior art compressor.

As shown in the drawings, the compressor 100 according to the present invention includes: a driving shaft 150 to which a swash plate 160 rotating in a swash plate chamber 136 inside the compressor 100 is inclinedly combined; front and rear cylinder blocks 130 and 140 respectively having shaft support holes 133 and 143 to which the driving shaft 150 is rotatably mounted; a plurality of pistons 170 mounted on the outer periphery of the swash plate 150 in such a manner as to interpose a shoe 165 between the piston and the swash plate, for performing a reciprocating motion inside cylinder bores 131 and 141 formed at both sides of the swash plate chamber 136 of the front and rear cylinder blocks 130 and 140 while cooperating with a rotating motion of the swash plate 160; front and rear housings 110 and 120 coupled with both sides of the front and rear cylinder blocks 130 and 140 and respectively having discharge chambers 111 and 121 formed therein; and valve units 180 interposed between the front and rear cylinder blocks 130 and 140 and the front and rear housings 110 and 120.

First, both ends of the driving shaft 150 are rotatably mounted in the shaft support holes 133 and 143 of the front and rear cylinder blocks 130 and 140, and in this instance, an end of the driving shaft 150 extends to pass through the front housing 110 and is connected with an electronic clutch (not shown), and the other end is perforated and fluidically communicated with a refrigerant storage chamber 124 of the rear housing 120, which will be described later.

The swash plate 160 rotating inside the swash plate chamber 136 is inclinedly combined to the driving shaft 150, and the driving shaft 150 has a main refrigerant suction flow channel 151 formed therein for fluidically communicating the swash plate chamber 136 and the cylinder bores 131 and 141 with each other, whereby refrigerant inhaled into the swash plate chamber 136 through a suction port 146 of the rear cylinder block 140 is flown to the cylinder bores 131 and 141 after passing through the swash plate 160.

An inlet 152 of the main refrigerant suction flow channel 151 is formed to be fluidically communicated with the swash plate chamber 136, and outlets 153 of the main refrigerant suction flow channel 151 are formed to be fluidically communicated with suction passageways 132 and 142 of the front and rear cylinder blocks 130 and 140 which will be described later.

Here, the inlet 152 of the main refrigerant suction flow channel 151 is formed by perforating a side of a hub 161 of the swash plate 160 and a side of the driving shaft 150. In this instance, it is preferable that the shortest distance (E) between the inner periphery of the inlet 152 of the main refrigerant suction flow channel 151 and the outermost side of the hub 161 is within the range of 1.5 mm to 2.5 mm due to a limitation in processing.

Therefore, the present invention can enhance a lubricating effect of a sliding part by forming the inlet 152 of the main refrigerant suction flow channel 151 in the swash plate 160.

Meanwhile, just one the inlet 152 of the main refrigerant suction flow channel 151 may be formed on the driving shaft 150 or two inlets 152 may be formed in the opposite directions from each other.

Furthermore, when the diameter of the main refrigerant suction flow channel 151 is A and the hydraulic diameter of the inlet 152 of the main refrigerant suction flow channel 151 is B, suction resistivity (R) of the inlet 152 of the main refrigerant suction flow channel 151 is defined as the following formula $$\frac{B}{A}$$

and satisfies the following formula, $0.5 \leqq R \leqq 1.3$. Here, the suction resistivity (R) means resistance applied to the refrigerant while the refrigerant is inhaled through the inlet 152.

Meanwhile, to form the inlet 152 of the main refrigerant suction flow channel 151, the side of the hub 161 of the swash plate 160 and the side of the driving shaft 150 must be processed, but in this instance, the hydraulic diameter (B) of the inlet 152 formed in the hub 161 of the swash plate 160 and the hydraulic diameter (B) of the inlet 152 formed in the driving shaft 150 may be different from each other due to an error in processing.

Therefore, the smaller of the hydraulic diameter (B) of the inlet 52 formed on the hub 161 and the hydraulic diameter (B) of the inlet 152 formed on the driving shaft 150 is used in the formula for calculating the suction resistivity (R).

In addition, if the suction resistivity (R) of the inlet 152 of the main refrigerant suction flow channel 151 is less than 0.5, a suction volume of refrigerant lacks during a high-speed rotation but there is no problem during a low-speed rotation of the compressor. Therefore, if refrigerant is inhaled due to a pressure difference between the inside of the cylinder bores 131 and 141 and the inside of the driving shaft 150, a volumetric efficiency drops due to the lack of refrigerant inside the driving shaft 150.

Furthermore, when the inlets 152 of the hub 161 of the swash plate 160 and the driving shaft 150 are processed, due to the limitation in processing, it is difficult that the suction resistivity (R) of the inlets 152 is more than 1.3.

Additionally, the outlets 153 of the main refrigerant suction flow channel 151 are formed at both sides of the main refrigerant suction flow channel 151 in the opposite directions, so that the refrigerant can be inhaled into the cylinder bores 131 and 141 disposed at both sides of the swash plate chamber 136 during the rotation of the driving shaft 150.

That is, since the swash plate 160 is formed inclinedly, the pistons 170 mounted on the outer periphery of the swash plate 160 and arranged in the opposite directions perform the same suction or compression stroke, the outlets 153 of the main refrigerant suction flow channel 151 must be formed oppositely so that the refrigerant can be inhaled to the cylinder bores 131 and 141 disposed at both sides of the swash plate 136 at the same time.

Of course, the directions of the outlets 153 of the main refrigerant suction flow channel 151 formed on the driving shaft 150 can be changed according to a design target, such as the number of the pistons 170.

In addition, the front and rear cylinder blocks 130 and 140 respectively have a plurality of the cylinder bores 131 and 141 formed at both sides of the swash plate chamber 136 formed therein, and shaft support holes 133 and 143 formed at the centers thereof for rotatably supporting the driving shaft 150.

Moreover, the front and rear cylinder blocks 130 and 140 respectively have the suction passageways 132 and 142 for fluidically communicating the shaft support holes 133 and 143 with the cylinder bores 131 and 141 so that the refrigerant inhaled from the swash plate chamber 136 to the main refrigerant suction flow channel 151 of the driving shaft 150 is inhaled to the cylinder bores 131 and 141 in order during the rotation of the driving shaft 150.

Furthermore, on the outer periphery of one of the front and rear cylinder blocks 130 and 140, formed are the suction port 146 fluidically communicating with the swash plate chamber 136 for supplying the outside refrigerant to the swash plate chamber 136, and a discharge port 147 fluidically communicating with the discharge chambers 111 and 121 for discharging the refrigerant contained inside the discharge chambers 111 and 121 of the front and rear housings 110 and 120 to the outside.

Therefore, the front and rear cylinder blocks 130 and 140 respectively have discharge passageways 134 and 144 for connecting the discharge chambers 111 and 121 of the front and rear housings 110 and 120 with the discharge port 147, and in this instance, mufflers 135 and 145 are respectively formed on the outer peripheries of the cylinder blocks 130 and 140 by expanding the discharge passageways 134 and 144 to reduce noise by decreasing pulsating pressure of the discharged refrigerant.

In addition, the valve unit 180 includes a valve plate 181 having a plurality of refrigerant discharge holes 181*a* for fluidically communicating the cylinder bores 131 and 141 with the discharge chambers 111 and 121 of the front and rear housings 110 and 120, and a discharge reed valve 182 mounted at a side of the valve plate 181 for opening and closing the refrigerant discharge holes 181*a*.

That is, the discharge reed valve 182 has reeds 182*a* mounted to direct the discharge chambers 111 and 121 of the front and rear housings 110 and 120 from the valve plate 181, and elastically transformed to open the refrigerant discharge holes 181*a* during the compression stroke of the pistons 170 and close the refrigerant discharge holes 181*a* during the suction stroke.

Furthermore, the valve plate 181 has communication passageways 181*b* for fluidically communicating the discharge chambers 111 and 121 with the discharge passageways 134 and 144 so that the refrigerant contained inside the discharge chambers 111 and 121 of the front and rear housings 110 and 120 is discharged to the discharge port 147 through the discharge passageways 134 and 144 of the front and rear cylinder blocks 130 and 140.

Additionally, the valve unit 180 has fixing pins 183 mounted at both sides of the valve plate 181 and inserted into fixing holes 112 formed on the surfaces of the front housing 110 and the front cylinder block 130 and on the surfaces of the rear housing 120 and the rear cylinder block 140, whereby the valve unit 180 is connected and fixed to the front and rear housings 110 and 120 and the front and rear cylinder blocks 130 and 140.

Meanwhile, the front and rear housings 110 and 120 respectively have a plurality of bolt coupling holes 113 and 123 formed on the rims of the inner peripheries thereof, and so, coupled and fixed to each other through the bolt coupling holes 113 and 123 via bolts 190 in a state where the above components are assembled therein.

The rear housing 120 has a refrigerant storage chamber 125 fluidically communicating with the swash plate chamber 136 through an auxiliary refrigerant suction flow channel 148, which will be described later. The refrigerant storage chamber 125 is divided from the discharge chamber 121 inside the discharge chamber 121.

Moreover, in the present invention, the refrigerant contained inside the swash plate chamber 136 is supplied into the cylinder bores 131 and 141 through the main refrigerant suction flow channel 151, and in this instance, the cylinder block 140 further has the auxiliary refrigerant suction flow channels 148 for fluidically communicating the swash plate chamber 136 with the refrigerant storage chamber 125, so that a sufficient flow rate can be supplied to the cylinder bores 131 and 141 even during the high-speed rotation of the driving shaft 150.

Here, it is preferable that a plurality of the auxiliary refrigerant suction flow channel 148 are axially formed around the shaft support hole 143 and formed between adjacent ones of the cylinder bores 141. In this instance, it is preferable that the shortest distance (D) between the center of the auxiliary refrigerant suction flow channel 148 and the shaft support hole 143 is within the range of 9 mm to 11 mm due to the limitation in processing.

Therefore, during the high-speed rotation of the driving shaft 150, the refrigerant contained inside the swash plate chamber 136 is supplied to the cylinder bores 141 through not only the main refrigerant suction flow channel 151 but also the auxiliary refrigerant suction flow channel 148, whereby the sufficient flow rate is supplied to enhance performance.

In addition, when the hydraulic diameter of the auxiliary refrigerant suction flow channel 148 is C, suction resistivity (R') of the auxiliary refrigerant suction flow channel 148 is defined as the following formula $$\frac{C}{A}$$

and satisfies the following formula, $0.46 \leqq R' \leqq 0.62$. If the suction resistivity (R') of the auxiliary refrigerant suction flow channel 148 is less than 0.46, a suction amount of the refrigerant inhaled to the cylinder bores 141 lacks, and so, performance is deteriorated. Furthermore, it is difficult that the suction resistivity (R') of the auxiliary refrigerant suction flow channel 148 is more than 0.62 due to the limitation in processing when the auxiliary refrigerant suction flow channel 148 is processed to the rear cylinder block 140.

FIG. 10 is a graph for comparing performance of the compressor according to the present invention with performance of the prior art compressor. In FIG. 10, the left graph is to compare performances between the present invention and the prior art when only the main refrigerant suction flow channel 151 is formed, and the right graph is to show performance of the present invention during the high-speed rotation when the auxiliary refrigerant suction flow channel 148 is also formed.

As you can see from the drawing, under the circumference of the high-speed rotation, the compressor, which has also the auxiliary refrigerant suction flow channel 148, is more improved in performance than the compressor, which has only the main refrigerant suction flow channel 151.

The present invention can improve performance during the high-speed rotation by supplying the sufficient flow rate since the auxiliary refrigerant suction flow channel 148 is additionally formed in the cylinder block 140.

As described above, in the compressor 100 according to the present invention, when the driving shaft 150, which selectively receives driving power from the electronic clutch (not shown), is rotated, the swash plate 160 is rotated, and in this instance, a plurality of the pistons 170 cooperating with the rotation of the swash plate 160 repeatedly perform refrigerant inhaling and compressing actions while reciprocating inside the cylinder bores 131 and 141 of the front and rear cylinder blocks 130 and 140.

That is, during the suction stroke of the pistons 170, the outside refrigerant is supplied to the swash plate chamber 136 through the suction port 146, and then, directly supplied to the cylinder bores 131 and 141 through the main refrigerant suction flow channel 151 of the driving shaft 150 and the auxiliary refrigerant suction flow channel 148 of the cylinder block 140. But, during the compression stroke of the pistons 170, the refrigerant supplied to the cylinder bores 131 and 141 is compressed by the pistons 170, discharged to the discharge chambers 111 and 121 of the front and rear housings 110 and 120, and then, discharged to the discharge port 147 through the discharge passageways 134 and 144 and the mufflers 135 and 145 of the front and rear cylinder blocks 130 and 140.

Hereinafter, the refrigerant circulating process will be described in more detail.

First, the refrigerant is supplied into the swash plate chamber 136 through the suction port 146, and then supplied into the cylinder bores 131 and 141 in order through the main refrigerant suction flow channel 151 of the driving shaft 150 and the auxiliary refrigerant suction flow channel 148 of the cylinder block 140 during the rotation of the driving shaft 150.

That is, as shown in FIG. 8, when the driving shaft 150 is rotated, the outlet 153 of the main refrigerant suction flow channel 151 formed in the driving shaft 150 is also rotated, and in this instance, the swash plate chamber 136 is fluidically communicated with the cylinder bores 131 and 141 during the process that the refrigerant passes through the suction passageways 132 and 142 where the outlet 153 is fluidically communicated with the cylinder bores 131 and 141, whereby the refrigerant contained inside the swash plate chamber 136 is supplied into the cylinder bores 131 and 141 through the main refrigerant suction flow channel 151.

Here, the refrigerant contained in the swash plate chamber 136 is continuously supplied to the cylinder bores 131 and 141 while the outlet 153 of the main refrigerant suction flow channel 151 is fluidically communicated with the suction passageways 132 and 142.

Moreover, during the process that the refrigerant contained in the swash plate chamber 136 is supplied into the cylinder bores 131 and 141 through the main refrigerant suction flow channel 151 of the driving shaft 150, as shown in FIG. 9, when the outlet 153 is continuously rotated and completely gets free from the suction passageways 132 and 142 where supply of refrigerant is going on, the communication between the swash plate chamber 136 and the corresponding cylinder bores 131 and 141 is interrupted, whereby, the supply of refrigerant toward the corresponding cylinder bores 131 and 141 is interrupted, and then, the pistons 170 perform the compression stroke in the cylinder bores 131 and 141 where the supply of refrigerant is interrupted.

As described above, while the driving shaft 150 is rotated, the cylinder bores 131 and 141 are fluidically communicated with the swash plate chamber 136 in order through the main refrigerant suction flow channel 151, and so, the refrigerant contained in the swash plate chamber 136 is supplied to the cylinder bores 131 and 141 and the pistons 170 perform the compression stroke in order inside the cylinder bores 131 and 141 where the supply of refrigerant is finished.

Of course, since the main refrigerant suction flow channel 151 formed in the driving shaft 150 simultaneously connects and fluidically communicates the swash plate chamber 136 with the cylinder bores 131 and 141 respectively formed on the front and rear cylinder blocks 130 and 140, suction and compression actions are simultaneously performed inside each of the cylinder bores 131 and 141 of the front and rear cylinder blocks 130 and 140.

Meanwhile, the refrigerant supplied through the auxiliary refrigerant suction flow channel 148 inside the swash plate chamber 136 passes the refrigerant storage chamber 125 of the rear housing 120, and then, is supplied to the cylinder bore 141 through the outlet 153 of the main refrigerant suction flow channel 151 and the suction passageway 142.

Continuously, during the compression stroke of the pistons 170, the refrigerant contained inside the cylinder bores 131 and 141 is compressed, and in this instance, the reeds 182*a* of the discharge reed valve 182 is elastically transformed and opens the refrigerant discharge hole 181*a* of the valve plate 181, whereby the cylinder bores 131 and 141 and the discharge chambers 111 and 121 of the front and rear housings 110 and 120 are fluidically communicated with each other, so that the refrigerant compressed inside the cylinder bores 131 and 141 is moved to the discharge chambers 111 and 121 of the front and rear housings 110 and 120.

After that, the refrigerant moved to the discharge chambers 111 and 121 of the front and rear housings 110 and 120 is moved into the mufflers 135 and 145 along the discharge passageways 134 and 144 of the front and rear cylinder blocks 110 and 120, and then, discharged through the discharge port 147.

As described above, the case where the structure of the driving shaft integrated type suction rotary valve, which has the main refrigerant suction flow channel 151 formed inside the driving shaft 150 for directly supplying the refrigerant contained inside the swash plate chamber 136 to the cylinder bores 131 and 141, is described in the present invention, but the present invention is not restricted to the above, and can be applied to compressors of various kinds, such as a motor driven compressor, in the same method and structure to obtain the same effects.

INDUSTRIAL APPLICABILITY

As described above, the present invention can directly supply the refrigerant supplied to the swash plate chamber to the cylinder bores through the main refrigerant suction flow channel formed inside the driving shaft, thereby enhancing suction volumetric efficiency of refrigerant by reducing a loss caused by flow channel resistance through simplification of the inner flow channel structure of the compressor and a loss caused by elastic resistance through omission of the prior art suction reed valve, and enhancing compression efficiency by uniformly distributing the refrigerant to each of the cylinder bores formed at both sides of the swash plate chamber.

Moreover, the present invention can enhance lubricating performance of the sliding part by oil since a flow of refrigerant is increased by forming the inlet of the main refrigerant suction flow channel on the swash plate side.

In addition, the present invention can enhance its performance during the high-speed rotation by supplying the sufficient flow rate since the auxiliary refrigerant suction flow channel is additionally, formed in the cylinder block.

The invention claimed is:

1. A compressor, which includes:

a driving shaft to which a swash plate rotating in a swash plate chamber inside the compressor is inclinedly combined, the driving shaft having a main refrigerant suction flow channel formed therein so that refrigerant inhaled into the swash plate chamber passes through the swash plate and moves toward cylinder bores;

front and rear cylinder blocks respectively having shaft support holes to which the driving shaft is rotatably mounted, a plurality of the cylinder bores formed at both sides of the swash plate chamber, and suction passageways for fluidically communicating the shaft support holes and the cylinder bores with each other so that the refrigerant inhaled into the main refrigerant suction flow channel of the driving shaft is inhaled into the cylinder bores in order during rotation of the driving shaft;

a plurality of pistons mounted on the outer periphery of the swash plate in such a manner as to interpose a shoe between the piston and the swash plate, for performing a reciprocating motion inside the cylinder bores while communicating with the rotation of the swash plate;

front and rear housings coupled with both sides of the front and rear cylinder blocks and respectively having discharge chambers formed therein; and valve units interposed between the front and rear cylinder blocks and the front and rear housings, wherein when the diameter of the main refrigerant suction flow channel is A and the hydraulic diameter of an inlet of the main refrigerant suction flow channel is B, suction resistivity (R) of the inlet of the main refrigerant suction flow channel is defined as the following formula $$\text{“}\frac{B}{A}\text{”},$$

and satisfies the following formula: $0.5 \leqq R \leqq 1.3$.

2. The compressor according to claim 1, wherein the rear housing further includes a refrigerant storage chamber, and the cylinder block further includes an auxiliary refrigerant suction flow channel for fluidically communicating the swash plate chamber and the refrigerant storage chamber with each other.

3. The compressor according to claim 2, wherein when the hydraulic diameter of the auxiliary refrigerant suction flow channel is C, suction resistivity (R') of the auxiliary refrigerant suction flow channel is defined as the following formula $$\text{“}\frac{C}{A}\text{”},$$

and satisfies the following formula, $0.46 \leqq R' \leqq 0.62$.

4. The compressor according to claim 2, wherein the auxiliary refrigerant suction flow channel is located between the adjacent ones of the cylinder bores.

5. The compressor according to claim 2, wherein the shortest distance (D) between the center of the auxiliary refrigerant suction flow channel and the shaft support hole is within the range of 9 mm to 11 mm.

6. The compressor according to claim 1, wherein the shortest distance (E) between the inner periphery of the inlet of the main refrigerant suction flow channel and the outermost side of a hub of the swash plate is within the range of 1.5 mm to 2.5 mm.

* * * * *